US011607006B2

(12) United States Patent
Maddox et al.

(10) Patent No.: US 11,607,006 B2
(45) Date of Patent: Mar. 21, 2023

(54) SHOE FOR LIMB LENGTH DISCREPANCY CORRECTION

(71) Applicants: Lisa Maddox, Grovetown, GA (US); Sloan Griffin, Jr., Greenwood, SC (US)

(72) Inventors: Lisa Maddox, Grovetown, GA (US); Sloan Griffin, Jr., Greenwood, SC (US)

( * ) Notice: Subject to any disclaimer, the term of this patent is extended or adjusted under 35 U.S.C. 154(b) by 0 days.

(21) Appl. No.: 16/983,186

(22) Filed: Aug. 3, 2020

(65) Prior Publication Data

US 2021/0145112 A1 May 20, 2021

Related U.S. Application Data

(60) Provisional application No. 62/882,245, filed on Aug. 2, 2019.

(51) Int. Cl.

| | |
|---|---|
| ***A43B 7/38*** | (2006.01) |
| ***A43B 3/24*** | (2006.01) |
| ***A43B 3/00*** | (2022.01) |

(52) U.S. Cl.

CPC ..... *A43B 7/38* (2013.01); *A43B 3/0031* (2013.01); *A43B 3/246* (2013.01)

(58) Field of Classification Search

CPC ..... A43B 7/16; A43B 7/38; A43B 3/0031

See application file for complete search history.

(56) References Cited

U.S. PATENT DOCUMENTS

| | | | | | |
|---|---|---|---|---|---|
| 1,637,565 | A * | 8/1927 | Gordon | A63B 21/065 | 36/132 |
| 2,509,423 | A * | 5/1950 | Cramer | A43B 7/38 | 36/97 |
| 4,813,162 | A * | 3/1989 | Harris | A43B 3/108 | 36/43 |
| 4,967,492 | A * | 11/1990 | Rosen | A43B 3/26 | 36/97 |
| 5,163,237 | A * | 11/1992 | Rosen | A43B 13/141 | 36/93 |
| 5,177,883 | A * | 1/1993 | Darby | A43B 3/26 | 36/97 |
| 2014/0215861 | A1* | 8/2014 | Burks | A43B 3/108 | 36/30 R |
| 2015/0223558 | A1* | 8/2015 | Qureshi-Pierce | A43B 7/16 | 36/81 |

* cited by examiner

*Primary Examiner* — Ted Kavanaugh
(74) *Attorney, Agent, or Firm* — Christopher M. Ramsey; GrayRobinson, P.A.

(57) ABSTRACT

A shoe includes a shoe upper that holds a wearer's foot when worn. A shoe sole is connected to the shoe upper and has a collapsible section including a body that at least partially defines a pocket in the collapsible section. An insert is installed in the pocket. The insert has a vertical thickness that expands the collapsible section and increases the vertical thickness of the shoe sole compared to when no insert is installed in the pocket. The shoe may be used for limb length correction.

9 Claims, 5 Drawing Sheets

SHOE FOR LIMB LENGTH DISCREPANCY CORRECTION

CROSS-REFERENCE TO RELATED APPLICATION

This claims the benefit of priority from provisional Application No. 62/882,245, filed Aug. 2, 2019, which is incorporated by reference in its entirety.

BACKGROUND

Leg length discrepancy is a condition that many people have. It occurs when one leg, for anatomical or functional reasons, is longer than the other. Leg length discrepancy can adversely affect walking, running, and balancing. It can also place unnatural stress on joints, which can cause pain and discomfort.

Various techniques are available to assist people with this condition. A common technique is to use a shoe lift. Shoe lifts attach to the patient's shoe on the shorter leg and artificially lengthen the leg. One form of shoe lift is inserted in to the shoe similar to an insole. Another form of shoe lift is strapped to the bottom of a shoe. Yet another form of a shoe lift is integrated with the sole of the shoe. All of these conventional approaches have drawbacks.

BRIEF SUMMARY

What is needed is an improved shoe that has a sole with an adjustable height. This gives the patient flexibility in terms of trying different sole heights to meet the patient's needs without needing to purchase an expensive new shoe. It also allows the patient to replace a worn out insert that increases the sole height.

An example of such a shoe includes a shoe upper that holds a wearer's foot when worn. The shoe also includes a shoe sole connected to the shoe upper, the shoe sole having a collapsible section including a body at least partially defining a pocket in the collapsible section. The shoe also includes an insert installed in the pocket, the insert having a vertical thickness that expands the collapsible section and increases the vertical thickness of the shoe sole compared to when no insert is installed in the pocket.

Some examples of the shoe may include one or more of the following features.

The pocket may extend from a heel end of the shoe to a toe end of the shoe.

The body may include resilient material that allows the body to contract and secure the insert in the pocket.

The collapsible section may include an opening providing access to the pocket, the opening being sealable.

The body may be at least partially composed of a resilient material that can stretch to accommodate the vertical thickness of the insert.

The collapsible section may give the shoe sole an adjustably variable thickness that depends on the vertical thickness of the insert.

The shoe sole may be a pre-existing shoe sole and the collapsible section may be attached to the pre-existing shoe sole.

The insert may be selectable from among a plurality of inserts having different vertical thickness.

The pocket and insert may extend from a heel end of the shoe to a toe end of the shoe.

An example of a method for treating leg length discrepancy in a human patient includes using a shoe having (i) a shoe upper that holds a wearer's foot when worn and (ii) a shoe sole connected to the shoe upper. The shoe sole has a collapsible section including a body at least partially defining a pocket in the collapsible section. The method also includes determining an amount of limb length correction needed for the patient and selecting an insert having a thickness based on the amount of limb length correction needed. The insert is installed into the pocket, thereby expanding the collapsible section and substantially correcting unequal limb length in the patient.

Some examples of the method may include one or more of the following features.

The pocket may extend from a heel end of the shoe to a toe end of the shoe.

The body may include resilient material that allows the body to contract and secure the insert in the pocket.

The collapsible section may include an opening providing access to the pocket, the opening being sealable.

The insert may extend from a heel end of the shoe to a toe end of the shoe.

The body may be is at least partially composed of a resilient material that can stretch to accommodate the vertical thickness of the insert.

The collapsible section may give the shoe sole an adjustably variable thickness that depends on the vertical thickness of the insert.

The shoe sole is may be a pre-existing shoe sole and the collapsible section may attached to the pre-existing shoe sole.

The insert may be selectable from among a plurality of inserts having different vertical thickness.

The pocket may include a slip-resistant mechanism that secures the insert in place within the pocket.

The method pocket and insert may extend from a heel end of the shoe to a toe end of the shoe.

DETAILED DESCRIPTION OF EXAMPLE EMBODIMENTS

This disclosure describes exemplary features and embodiments, but not all possible embodiments of the shoe, its features, and related methods. Where a particular feature is disclosed in the context of a particular example, that feature can also be used, to the extent possible, in combination with and/or in the context of other examples. The shoe and related methods be embodied in many different forms and should not be construed as limited to only the examples described here.

A shoe that may be used to correct unequal limb length is now described. The shoe includes a collapsible sole section that carries an insert that adjusts the height of the shoe's sole to even out limb length on people who have one leg shorter than the other. This shoe assists the wearer with mobility and comfort.

Figure 1:
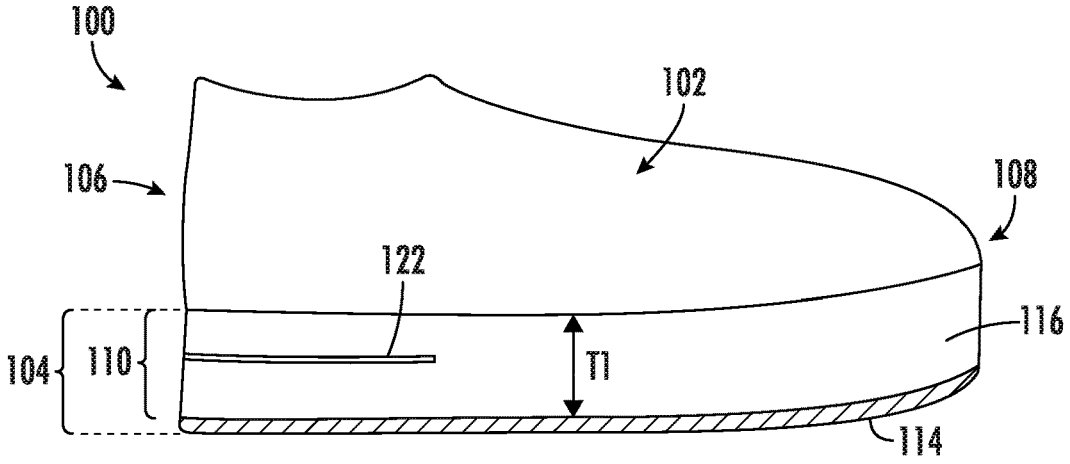
FIG. 1 is a side view of a first example of the shoe with the insert installed.
Figure 2:
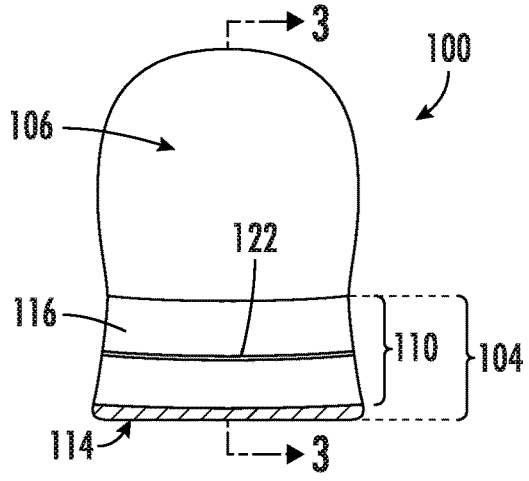
FIG. 2 is a rear view thereof.
Figure 3:
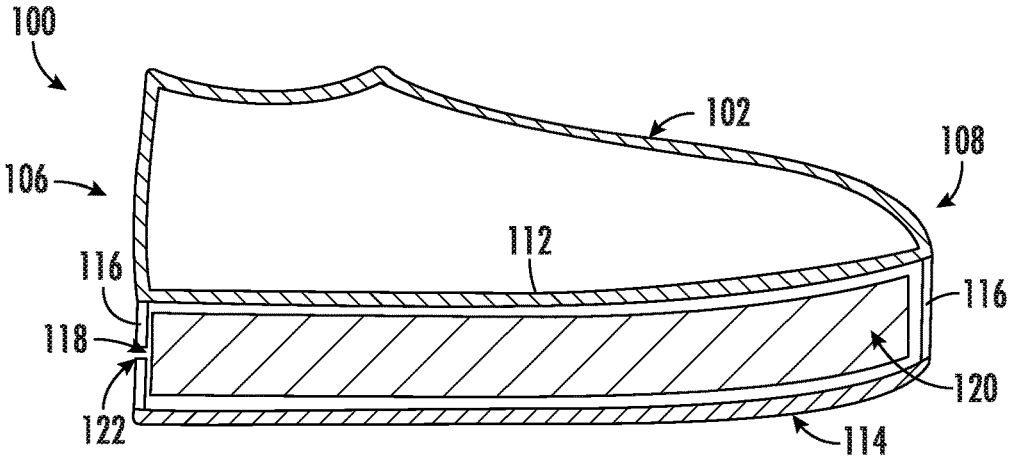
FIG. 3 is a cutaway view thereof taken along line 3-3 of FIG. 2.

Referring to FIGS. 1-3 an example of the shoe 100 includes a shoe upper 102 and a collapsible sole 104.

The shoe upper 102 is configured to hold the wearer's foot and extends from a heel end 106 that fits adjacent the wearer's heel to a toe end 108 that fits adjacent the wearer's toes. Some examples of the shoe upper 102 may include a mechanism for tightening the shoe upper against the foot. Such a mechanism may include any conventional shoe tightening mechanism such as laces, straps, resilient material, or the like, which may be tied and/or connected by buttons, hook and loop fasteners, or another conventional fastener. Alternatively, the shoe upper 102 may be of the slip-on type having no shoe tightening mechanism. Certain examples of the shoe upper 102 do not cover the wearer's heel. In other examples, the shoe upper 102 may be a strap or set of straps similar to those of a flip flop or sandal.

The shoe upper 102 may be constructed of conventional materials from which shoe uppers are made. Some examples of such materials include leather, fabric, plastic, rubber, foam, and/or the like.

The collapsible sole 104 is affixed to the bottom of the shoe upper 102 by a conventional mechanism such as adhesion, stitching, or the like.

The collapsible sole extends from the heel end 106 to the toe end 108 and includes a collapsible section 110 positioned between a footbed 112 and an outsole 114. When the shoe 100 is worn, the wearer's foot rests on the footbed 112. The footbed 112 may be padded for comfort and may be made of foam, polymer, stuffed fabric, or the like. The outsole 114 is designed to provide grip with the ground and to prevent damage to the rest of the collapsible sole 104 when worn. The outsole 114 may be constructed of any conventional shoe outsole material such as a rubber, polymer, or the like.

The collapsible sole section 110 includes a body 116 extending around the collapsible sole section 110 and defining a pocket 118 configured to receive an insert 120 through an insert receiving opening 122 defined through the body 116. The pocket 118 forms a hollow interior of the collapsible sole section 110. The pocket 118 extends from the heel end 106 to the toe end 108.

The insert receiving opening 122 may be positioned along the heel end 106 (as shown), toe end 108, or along a medial or lateral side of the body 116 extending between the heel end 106 and toe end 108. The insert receiving opening 122 in the example shown extends from the heel end 106 partially to the toe end 108. The length and position of the insert receiving opening 122 on the body 116 can vary depending on factors such as the insert 120 size, insert 120 construction, ease of installing the insert 120, aesthetics, and desired performance.

The insert receiving opening 122 may be sealed closed, if desired, to prevent the insert 120 from slipping out of the pocket 118. The seal mechanism may include a zipper, flap, button, hook and loop, strap, or other mechanism. In certain examples, the seal mechanism can be opened and closed repeatedly to remove and replace the insert 120 when desired.

Figure 4:
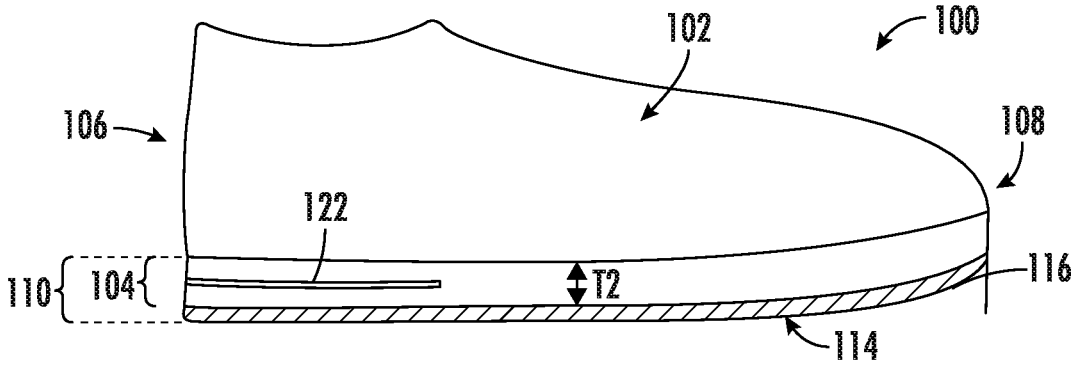
FIG. 4 is a side view of an example of the shoe with the insert removed.
Figure 5:
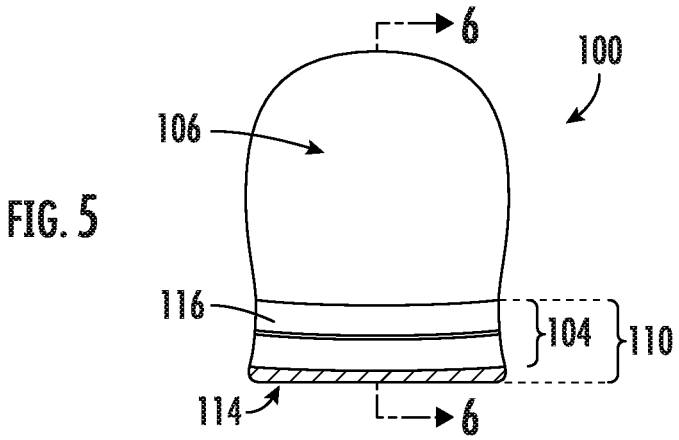
FIG. 5 is a rear view thereof.
Figure 6:
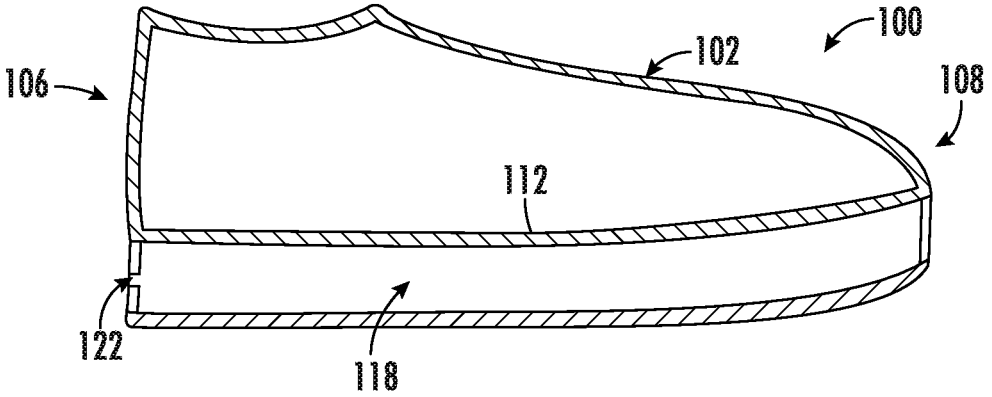
FIG. 6 is a cutaway view thereof taken along line 3-3 of FIG. 5.

Referring now to FIGS. 4-6, the shoe 100 is shown without the insert 120 installed in the pocket 118. By comparison with FIG. 1, when the insert 120 is installed, the collapsible sole section 110 has a first thickness T1, but when the insert 120 is absent, the collapsible sole section 110 has a second thickness T2, which is less than the first thickness T1.

The collapsible sole section 110 gives the sole 104 a variable thickness T1 that depends on the thickness of the insert 120. This feature gives the shoe 100 adjustability to meet the needs of the wearer. The thickness of the insert 120 can be selected based on the amount of length correction needed. For example, if two inches of length correction is needed, an insert 120 having a two inch thickness may be used.

In order to account for accommodating inserts 120 of different thickness, the body 116 may be composed at least partially of a resilient material that can stretch and contract. This function allows the body 116 to contract when no insert 120 is installed and to stretch to accommodate the thickness of the insert 120. The resilient material contracts against the insert 120 when installed and holds the insert 120 in place within the pocket 118. This prevents the insert 120 from being able to shift around in the pocket 118 during walking and prevents the sole 104 from flopping loosely when no insert 120 is installed or a thin insert 120 is installed.

Figure 7:
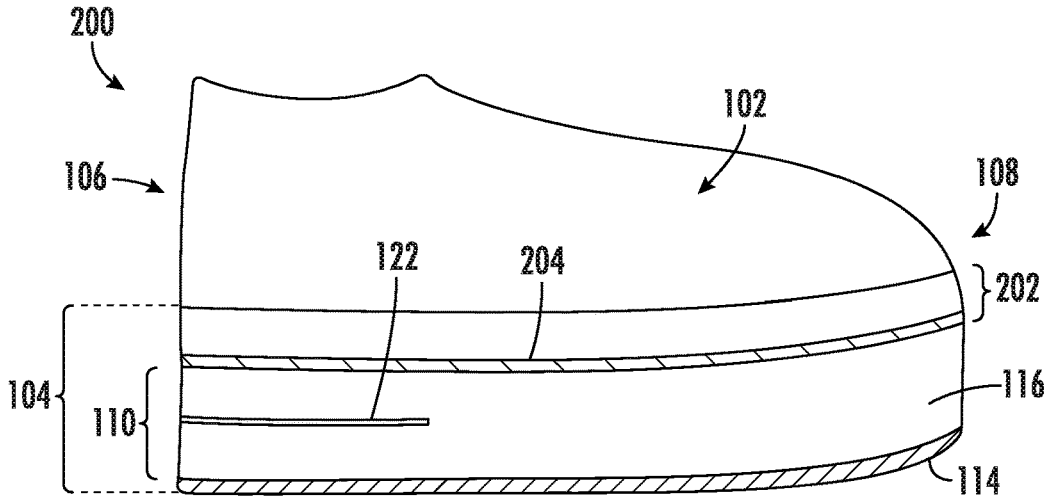
FIG. 7 is a side view of a second example of the shoe with the insert installed.
Figure 8:
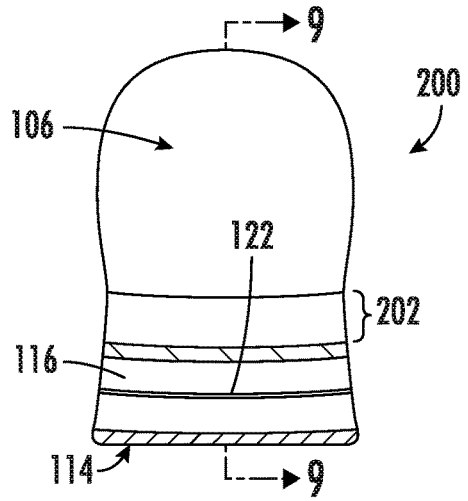
FIG. 8 is a rear view thereof.
Figure 9:
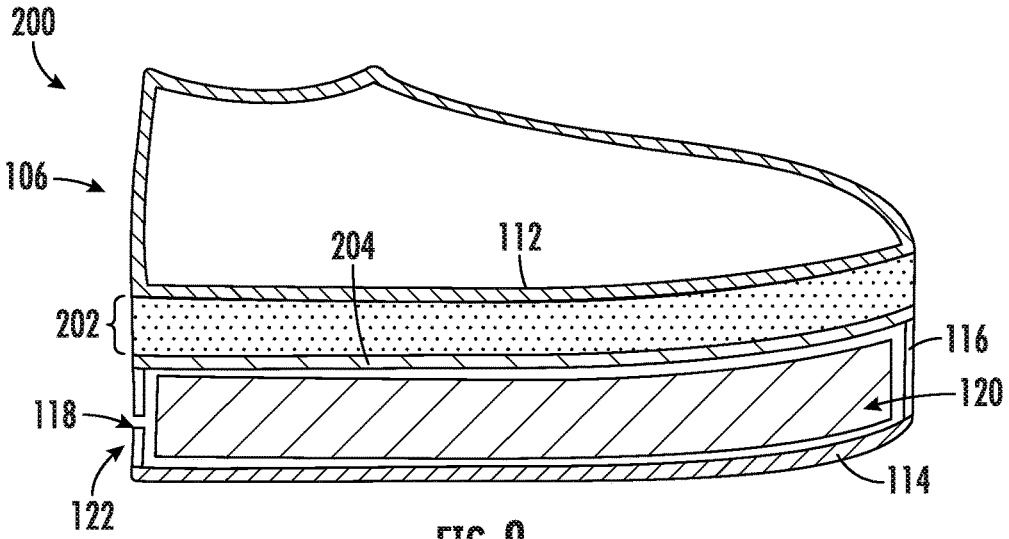
FIG. 9 is a cutaway view thereof taken along line 9-9 of FIG. 8.
Figure 10:
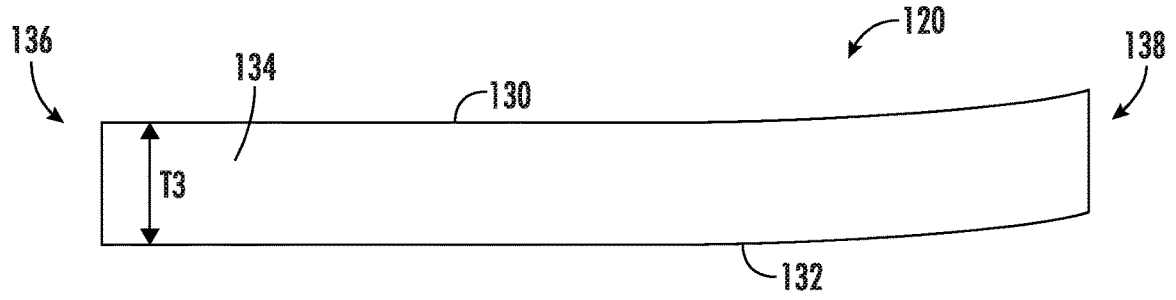
FIG. 10 is a side view of an example of an insert.
Figure 11:
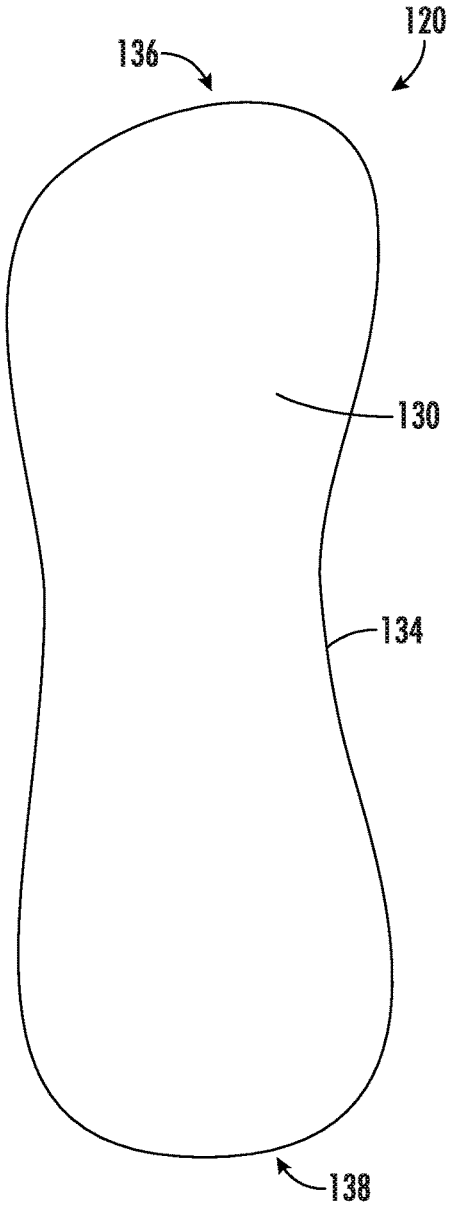
FIG. 11 is a top view thereof.
Figure 12:
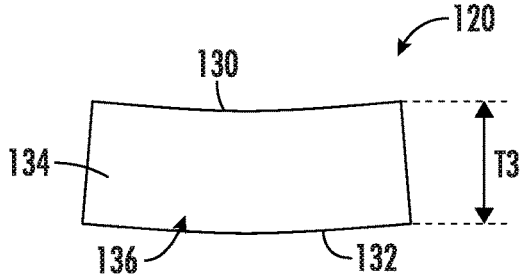
FIG. 12 is a rear view thereof
Figure 13:
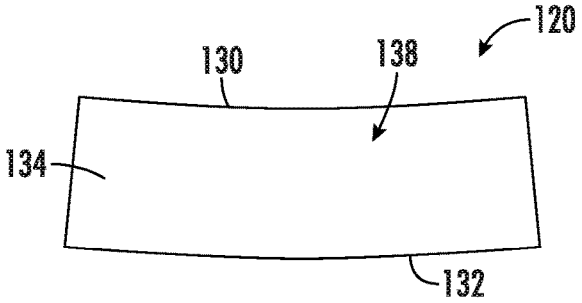
FIG. 13 is a front view thereof.
Figure 14:
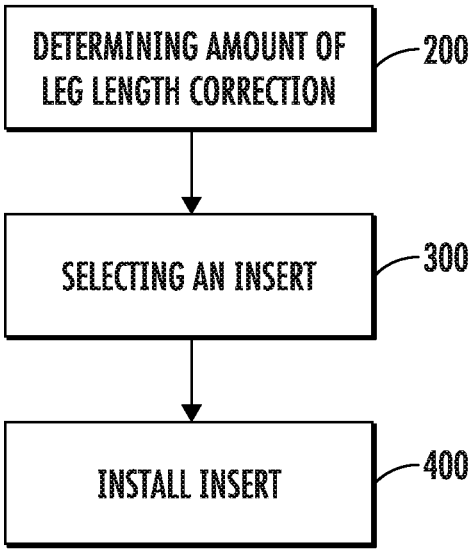
FIG. 14 is a flow diagram illustrating an example of a method of treating limb length discrepancy.

Referring now to FIGS. 7-9 an alternative example of the shoe 200 has different construction. The same reference numerals are used to refer to like parts of the shoe 100 and shoe 200. In this example the shoe includes a pre-existing sole 202 with an outsole 204. The collapsible sole 110 is attached to the pre-existing sole 202 by an adhering, stitching, or the like. In this configuration, the wearer's conventional shoe is modified by adding the collapsible sole 110 to it. The collapsible sole 104, in this example functions the same way as in shoe 100.

In order to further prevent the insert 120 from slipping and moving in the pocket 188, the pocket may include a slip-resistant mechanism in combination with the insert 120. The slip-resistant mechanism is designed to secure the insert 120 in place within the pocket 118. Examples of slip-resistant mechanisms may include adhesive tape, hook and loop fasteners, or the like. Adhesive tape may be placed within the pocket, such as on the bottom of the pocket, for example. Likewise, one portion of a hook and loop fastener may be placed on the bottom of the pocket and the mating portion of the hook and loop fastener may be attached to the bottom of the insert, for example.

The body is made of a durable material that is at least slightly resilient and flexible. Examples of such material may include synthetic stretchy fabrics such as polyester or the like.

Details of an example of the insert 120 will now be described with reference to FIGS. 10-13. The insert 120 includes a top side 130 a bottom side 132 and a sidewall 134 extending between the top side 130 and bottom side 132 and defining a thickness T3 of the insert 120. The insert further includes an insert heel end 136 and an insert toe end 138. The thickness T3 of the insert 120 can vary to meet the amount of length correction needed by the wearer.

The insert 120 is constructed of a material able to maintain its shape. Some examples of such materials may include rubber, crepe rubber, and foam.

The shoe 100 may be used to treat a person having unequal leg length. A method of treating such a person is now described with reference to FIG. 11.

At block 200, an amount of length correction is determined by measuring the length difference between a patient's legs. Such a measurement may be performed by a physician or other type of medical professional using conventional measurement techniques.

At block 300, an insert having a thickness based on the amount of length correction is selected. In some examples, the medical professional may have a plurality of pre-constructed inserts of different thickness from which to choose. In other examples, the medical professional may order the insert needed and have it custom-constructed to account for details about the shape of the patient's foot.

It is not always necessary for the thickness to exactly match the length difference. What is more important is that the thickness be sufficient to work for patient and meet the patient's preferences. It can sometimes take days or weeks to determine the best thickness for a particular patient, which is usually determined by gradually increasing thickness of the insert until the patient feels comfortable.

At block 400, the insert is installed into the pocket by sliding it through the insert receiving opening 122 and subsequently sealing the opening.

The shoe and related method are not limited to the details described in connection with the example embodiments. There are numerous variations and modification of the compositions and methods that may be made without departing from the scope of what is claimed.

That which is claimed is:

1. A method for treating leg length discrepancy in a human patient, the method comprising:

using a shoe having (i) a shoe upper that holds a wearer's foot when worn; and (ii) a shoe sole connected to the shoe upper, the shoe sole having a collapsible section including a body at least partially defining a pocket in the collapsible section;

determining an amount of limb length correction needed for the patient;

selecting an insert having a thickness based on the amount of limb length correction needed; and installing the insert into the pocket, thereby expanding the collapsible section and substantially correcting unequal limb length in the patient;

wherein (a) the body includes resilient material that allows the body to contract and secure the insert in the pocket and (b) the pocket and the insert extend from a heel end of the shoe to a toe end of the shoe.

2. The method of claim 1, wherein the pocket extends from a heel end of the shoe to a toe end of the shoe.

3. The method of claim 1, wherein the collapsible section includes an opening providing access to the pocket, the opening being sealable.

4. The method of claim 1, wherein the insert extends from a heel end of the shoe to a toe end of the shoe.

5. The method of claim 1, wherein the body is at least partially composed of a resilient material that can stretch to accommodate the thickness of the insert.

6. The method of claim 1, wherein the collapsible section gives the shoe sole an adjustably variable thickness that depends on the thickness of the insert.

7. The method of claim 1, wherein the shoe sole is a pre-existing shoe sole and the collapsible section is attached to the pre-existing shoe sole.

8. The method of claim 1, wherein the insert is selectable from among a plurality of inserts having different vertical thickness.

9. The method of claim 1, wherein the pocket includes a slip-resistant mechanism that secures the insert in place within the pocket.

* * * * *